US008556789B2

(12) United States Patent
Grunder et al.

(10) Patent No.: US 8,556,789 B2
(45) Date of Patent: Oct. 15, 2013

(54) METHOD FOR PRODUCING A PRINTED PRODUCT

(75) Inventors: Roland Grunder, Vordemwald (CH); Daniel Suter, Witnau (CH)

(73) Assignee: Mueller Martini Holding AG, Hergiswil (CH)

( * ) Notice: Subject to any disclaimer, the term of this patent is extended or adjusted under 35 U.S.C. 154(b) by 291 days.

(21) Appl. No.: 12/910,082

(22) Filed: Oct. 22, 2010

(65) Prior Publication Data

US 2011/0098169 A1 Apr. 28, 2011

(30) Foreign Application Priority Data

Oct. 23, 2009 (EP) ..... 09013445

(51) Int. Cl.
*B31F 1/00* (2006.01)

(52) U.S. Cl.
USPC ..... 493/356; 493/340; 493/361; 493/405

(58) Field of Classification Search
USPC ..... 493/356, 340, 361, 405
See application file for complete search history.

(56) References Cited

U.S. PATENT DOCUMENTS

| | | | | |
|---|---|---|---|---|
| 1,385,569 | A * | 7/1921 | Mayer et al. | 493/321 |
| 1,909,518 | A | 5/1933 | Boyce | |
| 4,746,107 | A | 5/1988 | Schneider et al. | |
| 4,900,001 | A * | 2/1990 | Lapeyre | 270/1.01 |
| 4,901,993 | A * | 2/1990 | Hansch | 270/21.1 |
| 5,348,277 | A * | 9/1994 | Crowley | 270/39.05 |
| 5,377,965 | A * | 1/1995 | Mandel et al. | 270/37 |
| 5,405,127 | A * | 4/1995 | Welborn | 270/21.1 |
| 5,494,270 | A | 2/1996 | Laubscher | |
| 5,961,758 | A | 10/1999 | Honegger | |
| 5,976,065 | A * | 11/1999 | Bellanca | 493/334 |
| 6,209,291 | B1 * | 4/2001 | Delen et al. | 53/450 |
| 6,248,051 | B1 * | 6/2001 | Bellanca | 493/334 |

(Continued)

FOREIGN PATENT DOCUMENTS

| | | | |
|---|---|---|---|
| DE | 3614263 | A1 | 10/1987 |
| DE | 9405167 | U1 | 5/1994 |

(Continued)

OTHER PUBLICATIONS

European Search Report completed Apr. 13, 2010 in EP 09 01 3445.3 (with English translation).

(Continued)

*Primary Examiner* — Hemant M Desai
(74) *Attorney, Agent, or Firm* — Venable LLP; Robert Kinberg; Tamatane J. Aga

(57) ABSTRACT

A method for producing a printed product in which a complete content of the printed product is printed sequentially in series on one or both sides along a paper web having a width based on a multiple of a width of a finished printed product, including cutting the paper web in a direction crosswise to a longitudinal direction of the paper web to produce a cut-off section having a length based on a multiple of a length of the finished printed product, folding the cut-off section at least once in the crosswise direction in a location based on the length of the finished product, and cutting one of the folded cut-off section subsequent to the folding or the paper web prior to the crosswise cutting, to form a plurality of partial webs each having a width based on the width of the finished printed product.

10 Claims, 4 Drawing Sheets

(56) References Cited

U.S. PATENT DOCUMENTS

| | | | | |
|---|---|---|---|---|
| 6,402,132 | B1 * | 6/2002 | Michaelis et al. | 270/1.01 |
| 7,556,247 | B1 * | 7/2009 | Delfer et al. | 270/21.1 |
| 7,978,349 | B1 * | 7/2011 | Clupper et al. | 358/1.13 |
| 2003/0022781 | A1 * | 1/2003 | Sosalla et al. | 493/463 |
| 2003/0044260 | A1 * | 3/2003 | Grunder et al. | 412/8 |
| 2007/0179037 | A1 * | 8/2007 | Dobrovolsky | 493/480 |
| 2009/0188360 | A1 | 7/2009 | Ishibuchi et al. | |

FOREIGN PATENT DOCUMENTS

| | | | |
|---|---|---|---|
| DE | 4316134 | A1 | 11/1994 |
| DE | 4408075 | A1 | 9/1995 |
| EP | 0 553 870 | | 8/1993 |
| EP | 0671247 | | 9/1995 |
| EP | 1481817 | A2 | 1/2004 |
| EP | 1440776 | A1 | 7/2004 |
| EP | 1 481 817 | | 12/2004 |
| EP | 1733988 | A1 | 12/2006 |
| EP | 2 075 208 | | 7/2009 |

OTHER PUBLICATIONS

"Guide to Print Media: Technologies and Production Methods," Publisher: Hemlut Kipphan, Springer Publishing House, Berlin, Germany, 2000, p. 43.

"Fold Types determine the Effective Advertising," Publisher: Bäuerle, MB, Bindereport, Germany, Apr. 1999, pp. 25-27.

* cited by examiner

METHOD FOR PRODUCING A PRINTED PRODUCT

CROSS-REFERENCE TO RELATED APPLICATION

This application claims the priority of European Patent Application No. 09013445.3, filed on Oct. 23, 2009, the subject matter of which is incorporated herein by reference.

BACKGROUND OF THE INVENTION

The invention relates to a method for producing a printed product for which the complete content of the printed product may be printed sequentially in series along a paper web. The printed paper web may be subsequently processed further to form a printed product. The paper web may be printed on one side or both sides. The width of the paper web may be based on at least a first format extent with respect to the finished printed product.

Such a method for the processing of individual sheets is disclosed in the prior art. With this method, the printed paper web is cut longitudinally into web sections and is then cut crosswise into individual sheets, corresponding to the predetermined format for the printed product. Each web section contains sequentially in series all pages of a printed product. The individual pages belonging to a printed product are stacked one above the other and are then supplied, for example, to a binding process. However, with this method the system is highly susceptible to malfunctions and failures connected to the mechanical elasticity of the paper. Furthermore, in connection with the transport and stacking of the individual sheets, initial susceptibility to malfunctions and failures increases with this method when the web speed increases because of the properties of the paper, meaning it affects the precise alignment of the individual sheets in the stack. If the individual sheets in a stack are not aligned correctly 100 percent, that is if the individual sheets in the stack are not aligned one above the other, it may be very difficult to achieve this alignment later on, thereby resulting in a high amount of waste paper. Furthermore, if only one sheet in the stack is not aligned on top of another, this may be sufficient reason for ejecting the whole stack.

Different attempts have been made to improve the transport and stacking operations with the aid of auxiliary measures to correct this problem. However, these measures have only made the system more complicated. Attempts were even made in part to reduce the web speed for the printed paper, to minimize the crosswise forces acting upon the printed product during the transport and stacking. However, web speed reduction did not have the expected results apart from causing a reduction in the production.

SUMMARY

It is an object of the present invention to provide a solution for correcting this problem. Steps are proposed for a method of the aforementioned type which may correct the disadvantages of the known methods. The problem defined herein may be seen in connection with the growing requirements connected with the operation of printing presses, for example modern digital printing presses, for which a goal may be to maximize the width of the paper web as well as the web speed for the printed paper in order to meet economic requirements.

The above and other objects are accomplished according to one aspect of the invention wherein there is provided a method for producing a printed product in which a complete content of the printed product is printed sequentially in series on one or both sides along a paper web having a width based on a multiple of a width of a finished printed product, which in one embodiment, includes cutting the paper web in a direction crosswise to a longitudinal direction of the paper web to produce a cut-off section having a length based on a multiple of a length of the finished printed product, folding the cut-off section at least once in the crosswise direction in a location based on the length of the finished product, and cutting one of the folded cut-off section subsequent to the folding or the paper web prior to the crosswise cutting, to form a plurality of partial webs each having a width based on the width of the finished printed product.

In another embodiment there is provided a method for producing a printed product in which a complete content of the printed product may be printed sequentially in series on one or both sides along a paper web having a width based on a multiple of a width of a finished printed product, including cutting crosswise to the longitudinal direction of the printed paper web to produce a cut-off section having a length based on a multiple of a length of the finished printed product, folding the cut-off section at least once in a crosswise direction in a location based on the length of the finished product, and cutting the folded cut-off section in a longitudinal direction to form at least one partial web of the paper web having a width based on the width of the finished printed product.

The aforementioned measures may increase the stiffness of the products up to the maximum value. The stiffness itself may be a measure for the resistance of a body against deformation by a force. This stiffness may depend on the material strength of the body. With printed products, however, this material strength may represent a characteristic for forming an operatively usable degree of stiffness because of a minimum mechanical resistance of the material (paper).

Thus, if a plurality of superimposed layers are created as a result of folding the printed sheet once or a plurality of times, then the resistance moment of such a folded body may also increase.

Since the mathematical square of the height of a body enters into the resistance [R] formula for determining the coefficient of resistance, it follows that even with a simple first folding the resistance moment, which induces the stiffness against bending, theoretically increases four fold, wherein a small reduction of this factor may be expected since the individual superimposed sheets may not enter into a body-merging connection.

In this embodiment, on the other hand, the layers have a connecting fold along an edge following each folding over. On the one hand, the folding over may increase the primary stiffness. On the other hand, the folding over may result in a higher resistance, if need be, to crosswise torsional forces.

Since these forces acting upon a body can occur again and again during a transport designed for high performance and the subsequent stacking of printed sheets, it may be important to take corrective action. These forces acting upon the transport and stacking are also tied to the fact that the system may have acceleration phases and inter-temporal delays, so that even a first folding may have a favorable effect by causing a strong reduction in the elasticity of a body formed in this way.

Seen this way and compared to a simple, non-folded printed sheet, a smooth multiplication of the resulting stiffness may be obtained for the transport and stacking of such a printed sheet if it is folded once or multiple times, which may be advantageous because the material-related resistance of the printed sheet per se may generally be categorized as minimal.

Thus, the secure positioning of the body following a translational transport movement may be increased if the elasticity is minimized, thereby also increasing the ability of the folded printed sheet to remain in place within the stack and not slide, meaning that once a position is assumed it may be stable. As compared to a loose page, a printed sheet with the same final surface but which has been folded once or a plurality of times also may have a correspondingly higher stiffness moment, which may be advantageous for the position stability during the transport and stacking.

A further advantage is that the printed sheet may experience an increase in stiffness with each folding in the crosswise direction because the width of the partial web section remains untouched during such an action, which may result in reducing the surface while the mass may be simultaneously doubled.

With the increase in the stiffness moment, the counter force of the body composed of printed sheets also may increase proportional to its mass because of the gravitational force, thereby further increasing the ability to remain in place, especially if these folded printed sheets are stacked.

Accordingly, the stack formed with the folded printed sheets may have a strong internal surface tension which ensures that the printed sheets remain stacked on top of one another within the stack during the complete operation. In the event that interfering crosswise forces appear during the transport and stacking of these printed sheets, these forces may no longer cause an internal displacement of the individual printed sheets, thereby ensuring the compactness of such stacks and rendering the subject of waste paper obsolete.

The folding of the printed sheet may permit the processing speed of a digitized printing operation to be considerably increased. The clocking frequency of the printed sheets to be stacked may be reduced by the factor of 2 for each folding operation if the web speed remains the same.

The folding(s) of the printed sheets may take place before or after at least one cutting operation. This may ensure a high flexibility for the production, wherein a distinction may be made whether the at least one cutting operation is realized in a longitudinal direction or a crosswise direction thereto. A distinction may furthermore be made to determine whether the folding operation is a simple, or a double, or a multiple folding operation.

A single fold or multiple folds may be made over the complete width of the printed paper web. Subsequently, following the folding operation(s), the individual printed sheets may be cut to a specific width in the longitudinal direction of the paper web and may be then respectively supplied to a stack. Thus, if the width of the paper web is cut, for example into four longitudinal partial webs, four parallel stacks may be consequently obtained.

According to another embodiment of the invention, there is provided a method for producing a printed product in which a complete content of the printed product may be printed sequentially in series on one or both sides along a paper web having a width based on a multiple of a width of a finished printed product, including cutting the paper web in a longitudinal direction to form at least one partial web having a width based on the width of the finished printed product, cutting the paper web in a direction crosswise to the longitudinal direction of the paper web to form a cut-off section for which a length is based on a multiple of a length of the finished printed product, and folding the partial web at least once in a crosswise direction in a location based on the length of the finished product.

Thus, the paper web may be first divided in the longitudinal direction into partial webs before the folding takes place, meaning the partial webs are consequently folded crosswise to the previously realized cuts in the longitudinal direction of the paper web, resulting in a number of printed sheets which may correspond to the number of previously created partial webs.

If the operation involves a double or multiple folding, a combination of four pages or eight pages, respectively printed on both sides, may be obtained. Independent thereof, the cuts in the longitudinal direction of the paper web in this case may also be made before or after the folding operations, in the same way as explained in the above for a single folding operation.

A crosswise perforation of the paper web may be realized ahead of time, meaning before the cuts in the longitudinal direction of the paper web made prior to the folding operation, as well as the cuts made after the folding operation or operations. The perforation may coincide with the respectively following folding plane. A fold may thus be created which is extremely flat, so that no upward bulging of the folded edges occurs. Such an upward bulging along one side of the edge zone, which may add up, may have negative effects on the further processing of the book blocks.

Embodiments of the invention are described in further detail in the following with the aid of the drawing. Features which are not needed for an easier understanding of embodiments may be omitted, wherein the same features may be given the same reference numbers in the different Figures.

BRIEF DESCRIPTION OF THE DRAWINGS

The present invention will be more readily understood from the following detailed description when read in conjunction with the accompanying drawings, in which.

DETAILED DESCRIPTION

Figure 1:
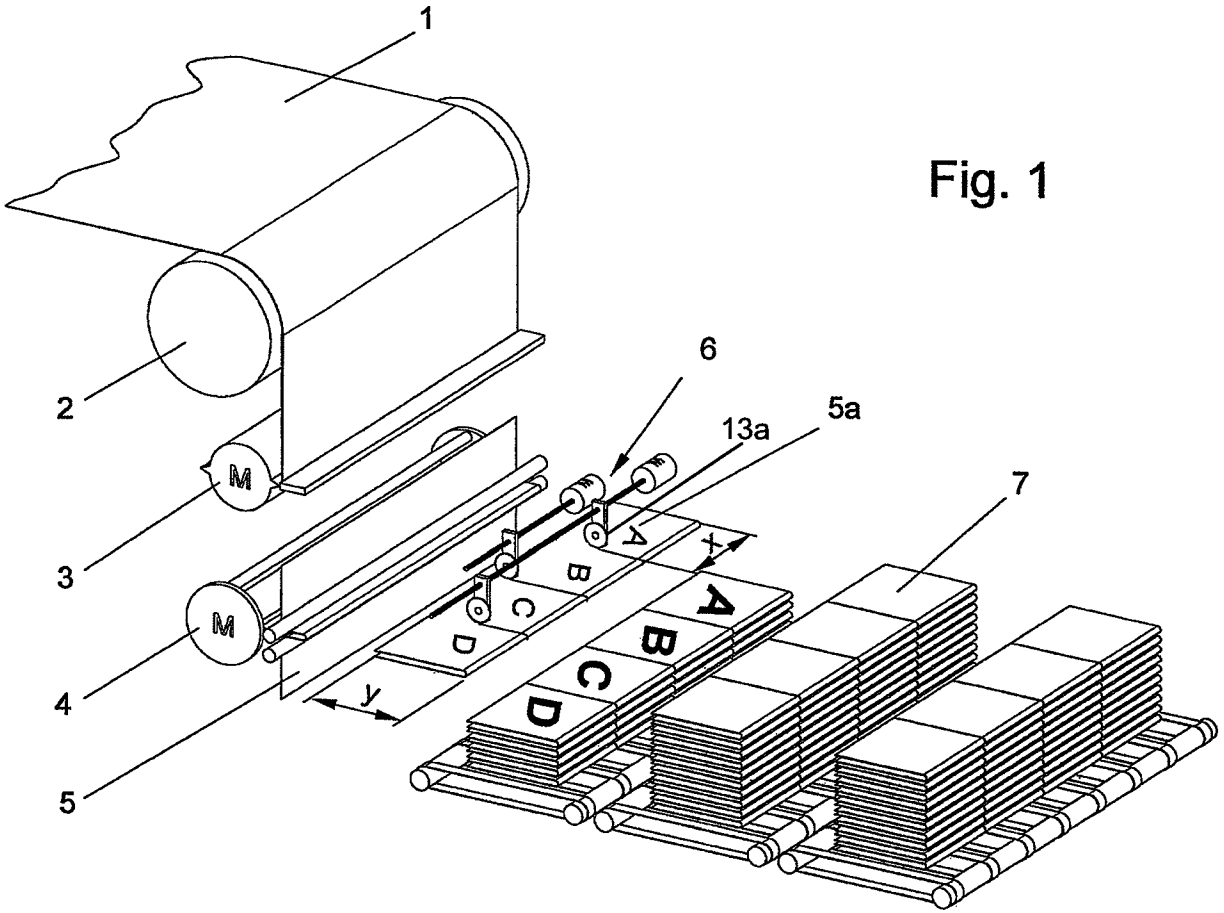
FIG. 1 shows a perspective schematic of a sequentially printed paper web with a single fold and a subsequent separating cut in a longitudinal direction and stacking of the folded printed sheets.

FIG. 1 shows a sequentially printed paper web 1, which may be printed on both sides. With the aid of an operative connection to a deflection roll 2, the paper web 1 may be transferred from a horizontal to a vertically extending path. The 90° deflection, shown herein, may not be system relevant per se because any other type of paper web guidance may also be possible, based on the available space. In principle, a deflection may not be required, as shown, for example, in FIG. 2.

FIG. 1 shows that following the deflection, a motor-driven cutting device 3, e.g., a rotary cutter, is used to cut a section having a specific length, in a direction crosswise to its longitudinal direction, from the paper web 1. This length may be determined to be such that it allows a one-time folding of the printed sheet with the aid of the folding sword 4 during the following folding operation. Subsequently, the folded printed sheet 5 may be divided into a plurality of partial web sections A-D (5*a*) with the aid of cutting devices 6 or cutting modules. When making these cuts, it may be advantageous for the cutting stability of the individual partial webs if the individual cutting elements 13*a* do not operate simultaneously along an advancing cutting plane. A cutting technique of this type, which may be offset in the cutting direction, follows from FIG. 1 (see also FIGS. 2-4). The individual printed sheets A-D (5*a*) may be then stacked and palletized, thereby resulting in individual book blocks 7 which can be supplied to a further processing station. Respectively four pages, two double-sided sheets, of a book block are thus produced with a single folding operation.

The degree of stiffness of the folded printed sheet may be increased considerably with such a folding operation, based on the finding that the stiffness itself may be a measure for the resistance of a body against deformation by a force. This stiffness may depend primarily on the cross section of the body. Owing to the thin layer of the sheet and its material (paper), the resistance moment may be an important factor in forming a degree of stiffness that may be advantageous for transport and stacking, particularly for printed products. With each reduction in the elasticity of the printed sheet, predetermined by the material, the secure transportability of such a body may increase immediately, thus also making possible a stable stacking position. If all printed sheets belonging to a book block are stacked in an orderly manner on top of one another, then the further processing of these book blocks may be qualitatively ensured. Otherwise, expensive remedial measures may have to be taken for which the success may not be ensured, such as at least one of pressing or pushing the individual sheets which are not evenly stacked back into the sheet stack. This type of remedial action may be practically impossible and such a book block may be usually rejected for quality considerations.

Of course, a reduction in the production cadence may not have to be tolerated as a result of the folding. Owing to the fact that a wide paper web may be used in this case, four or more partial webs can be provided without problems, wherein these partial webs may be respectively assigned to one book block. As a result, it may be possible with such a system to achieve a considerable increase in the productivity as compared to the production and stacking of individual printed sheets which are not folded, even if the printing speed for the system remains the same.

Figure 2:
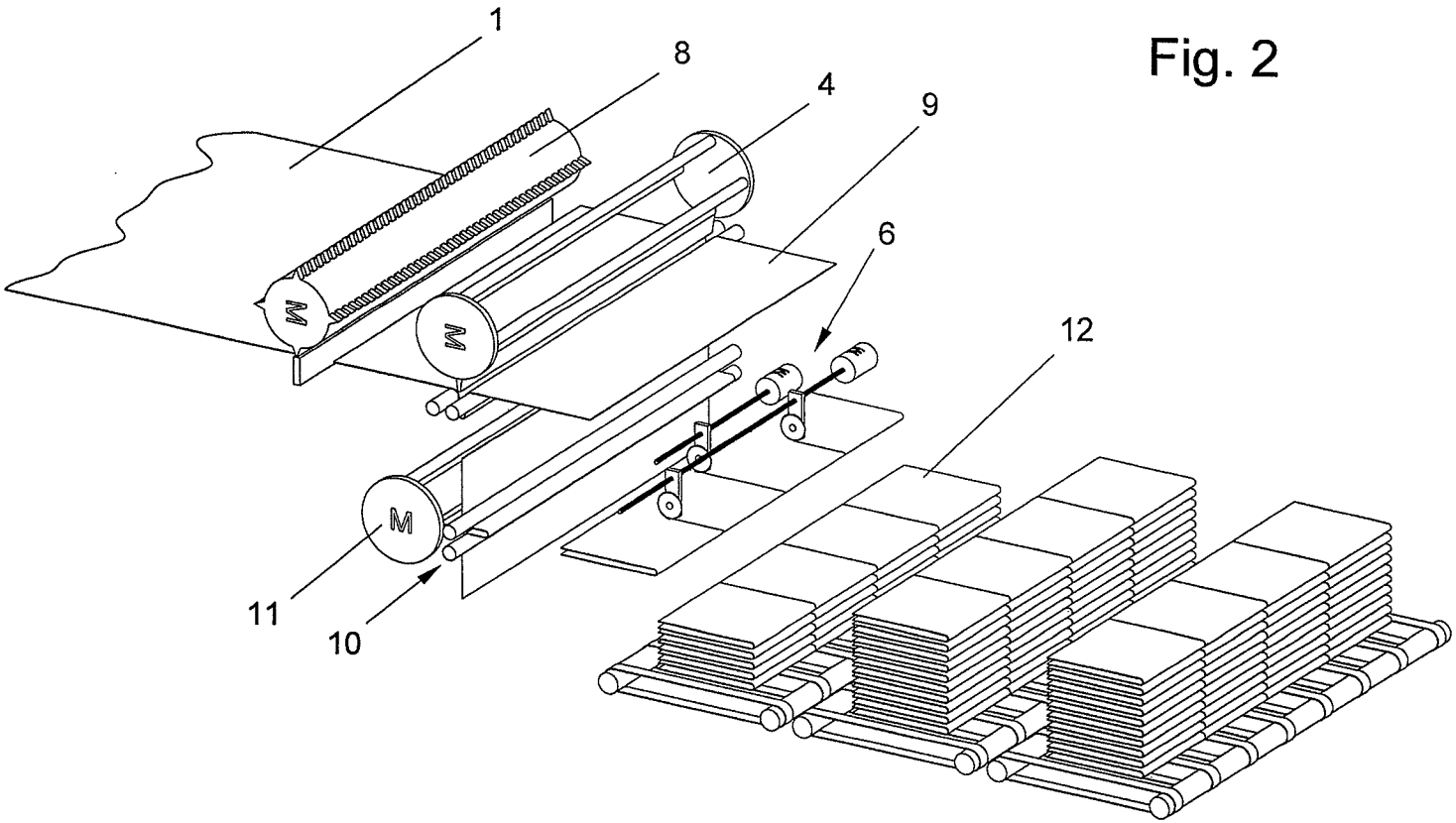
FIG. 2 shows a perspective schematic of a sequentially printed paper web with double folding and subsequent cut made in the longitudinal direction with a double fold and stacking of the folded printed sheets.

FIG. 2 differs from FIG. 1 in that it may be based on a double folding operation. In addition, a perforation roller 8 which realizes a double function may be used prior to the first folding operation. For one thing, this roller 8 may be used to generate a perforation in crosswise direction of the paper web while the same roller 8 functions during the following cycle as a cutting device, for example as a cutting blade. Thus, the cut-off section of a printed sheet 9 may be provided in the center with a perforation, not shown in further detail in the drawing, which may form the plane for realizing the first folding operation that may be carried out with a folding sword 4. Following this first folding operation, the printed sheet may be supplied to a further station 10 where a second folding sword 11 may be used for the second folding operation.

A sheet may be thus obtained which has been printed on eight times and, following the cut in the longitudinal direction of the paper web, analogous to the cut shown in FIG. 2, an eight-page printed sheet 12 may be produced. The stiffness of the sheet may now amount to multiple times that which can be achieved with a single folding. The elasticity of such a body may be consequently reduced to such a degree that the transport as well as the stacking can take place with maximum position and layer safety. Of course, the system can be expanded to include three additional folding operations in which case the individual printed sheet would contain sixteen printed pages.

Locating the first folding in the perforation plane may have a double positive effect. On the one hand, it may be easier to realize the folding in this plane since the resistance in this plane may be decreased because of the perforation and the folding plane may be already specified in this case, which results in a strong preset for the location of this operation. On the other hand, a flat area of transition may form in the back region of the fold between the two folded pages, relative to each other. During the stacking, this flat region may be advantageous since the book block may not tend to bulge out along the edges which could represent a serious obstruction during the further processing.

Figure 3:
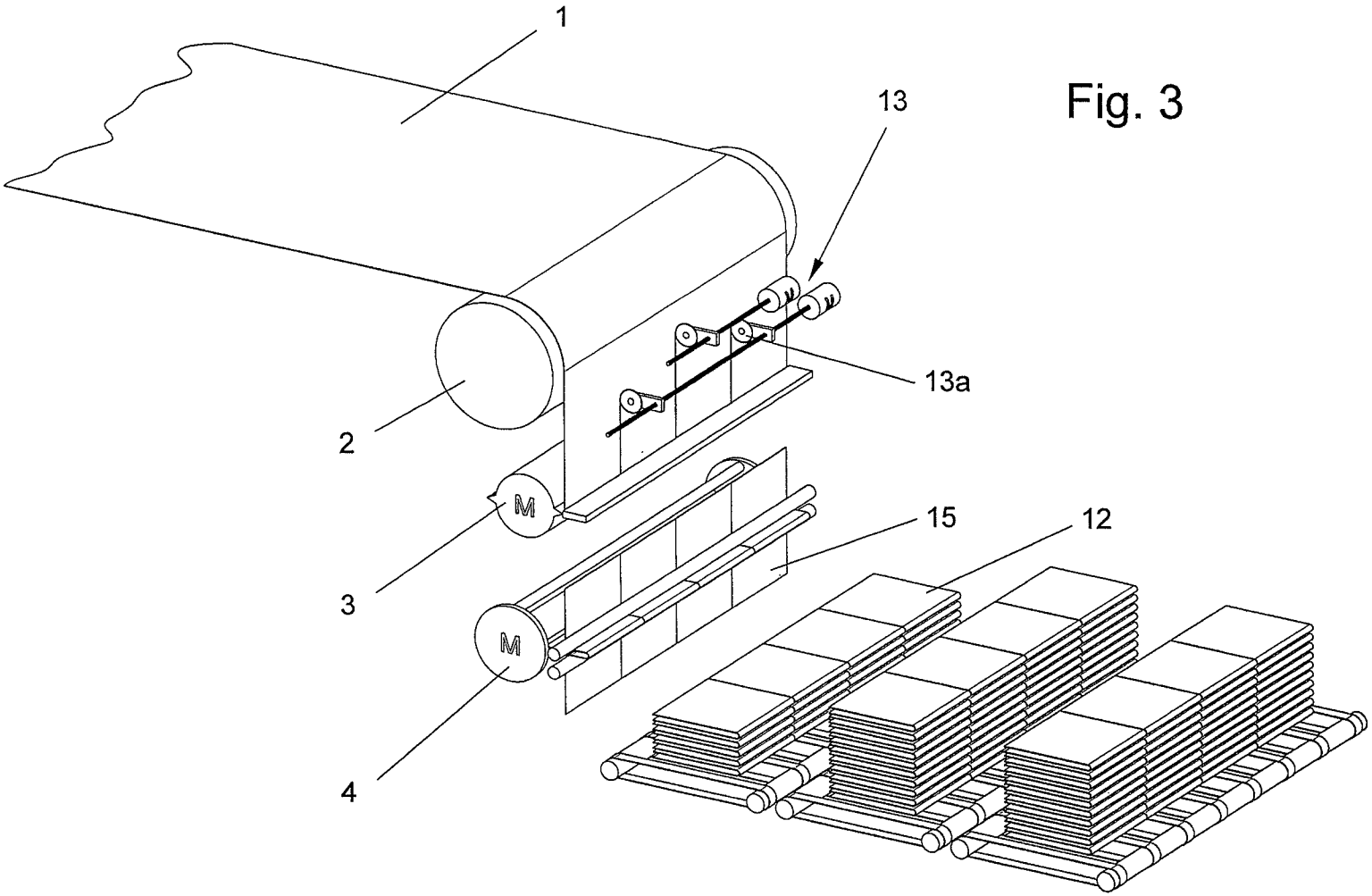
FIG. 3 shows a perspective schematic of a sequentially printed paper web with a single fold, wherein the cut in the longitudinal direction of the paper web is realized before the folding operation.

With respect to a single fold, the steps shown in FIG. 3 correspond to the previously shown steps in FIG. 1, with a difference that the cutting step 13 made in the longitudinal direction of the paper web for forming individual printed sheet sections may be carried out prior to the actual folding operation. It means that individual, cut printed sheet sections 15 may already exist during the folding operation, which may be then conveyed further and stacked in the proven manner to form book blocks 12, wherein this may not affect the stiffness of the individual printed sheets 15. The stiffness achieved through the folding may be maintained in this case as well.

Figure 4:
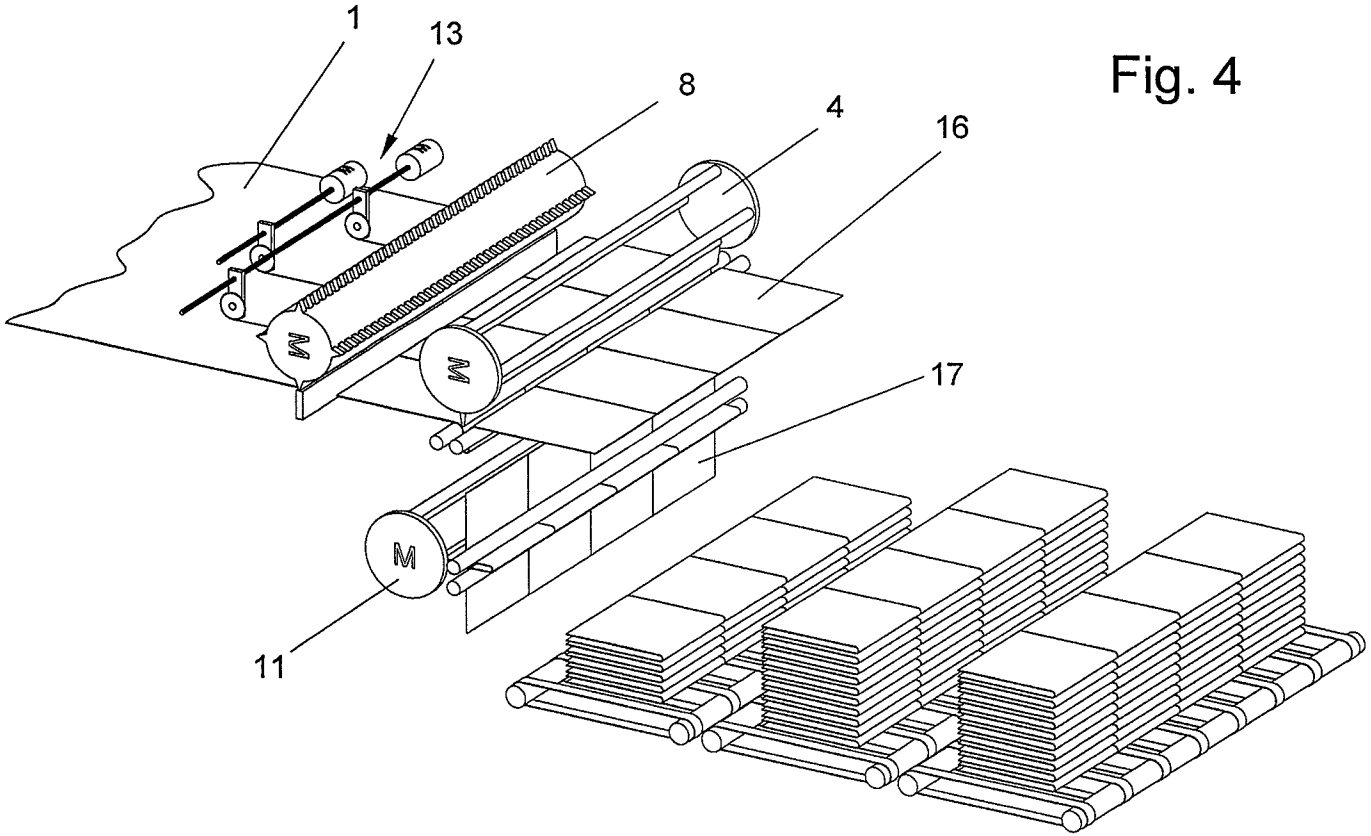
FIG. 4 shows a perspective schematic of sequentially printed paper web with a double fold, wherein the cut in the longitudinal direction of the paper web is realized ahead of the folding.

The same can be said with respect to FIG. 4. On the one hand, the steps shown in FIG. 4 correspond to those shown in FIG. 2 with respect to the crosswise perforation of the paper web and the double folding. Regarding the length of the individual printed sheets 16 in the longitudinal direction of the paper web, the separating cut along the paper web with the cutting device 13 may be realized before the perforation and/or separating cut is made in crosswise direction of the paper web.

Physical considerations regarding the increase in stiffness of the printed sheet after one or a plurality of folding operations are previously explained in the Summary.

For all embodiments, at least one folding operation may occur off center, thereby creating a so-called gripper fold or a binding flap, which may be advantageous if supplements or additional printed products are inserted into such a printed sheet during the course of the further processing since the gripper fold or the binding flap may provide an unambiguous reference surface for the respective spreading device.

As previously mentioned, not only a single folding operation or two folding operations may be realized, but also three or more. If initially a higher fold number is specified, it may be increased or reduced continually during the course of forming a book block. In particular with a higher number of connected folds, reflected in the number of pages of the book block (3 folding operations result in a printed product with 16 pages), it may be possible to change to a lower number of folds during the end phase to avoid having empty pages in the book block.

It will be understood that the above description of embodiments of the invention is susceptible to various modifications, changes and adaptations, and that the same are intended to be comprehended within the meaning and range of equivalents of the appended claims.

What is claimed is:

1. A method for producing a printed product in which a complete content of the printed product is printed sequentially in series on one or both sides along a paper web having a width based on a multiple of a width of a finished printed product, comprising:

cutting crosswise to the longitudinal direction of the printed paper web to produce a cut-off section having a length based on a multiple of a length of the finished printed product;

after cutting crosswise to the longitudinal direction of the printed paper web, folding the cut-off section at least once in a crosswise direction in a location based on the length of the finished product; and cutting the folded cut-off section in a longitudinal direction to form at least one partial web of the paper web having a width based on the width of the finished printed product.

2. The method according to claim 1, wherein the step of folding the cut-off section includes folding the cut-off section at least twice crosswise to the longitudinal direction of the paper web and the step of cutting the folded cut-off section includes forming at least two parallel extending partial webs in the longitudinal direction of the paper web.

3. The method according to claim 1, further comprising changing a number of foldings in a direction crosswise to the longitudinal direction of the paper web intermittently or at certain points during a course of forming a book block.

4. The method according to claim 3, wherein changing the number of folding is based on a number of pages of the book block.

5. The method according to claim 1, further comprising perforating the paper web crosswise to the longitudinal direction of the paper web prior to the folding of the paper web to form at least a plane for a first folding in the crosswise direction.

6. The method according to claim 1, wherein the step of cutting in the longitudinal direction of the paper web includes cutting with motor-driven cutting modules.

7. The method according to claim 6, wherein the step of cutting in the longitudinal direction includes operating the cutting modules with an offset, relative to each other, in the longitudinal direction of the paper web.

8. The method according to claim 1, wherein the step of cutting crosswise to the longitudinal direction of the paper web includes cutting with a motor driven cutter.

9. The method according to claim 1, wherein the step of folding the cut-off section at least once in the crosswise direction includes making at least one off-center crosswise fold.

10. A method for producing a printed product in which a complete content of the printed product is printed sequentially in series on one or both sides along a paper web having a width based on a multiple of a width of a finished printed product, comprising:

cutting the paper web in a direction crosswise to a longitudinal direction of the paper web to produce a cut-off section having a length based on a multiple of a length of the finished printed product;

after cutting the paper web in a direction crosswise to a longitudinal direction of the paper web, folding the cut-off section at least once in the crosswise direction in a location based on the length of the finished product; and cutting one of the folded cut-off sections subsequent to the folding of the paper web prior to the crosswise cutting, to form a plurality of partial webs each having a width based on the width of the finished printed product.

* * * * *